US009561919B2

(12) United States Patent
Yanase et al.

(10) Patent No.: US 9,561,919 B2
(45) Date of Patent: Feb. 7, 2017

(54) PAPER FEEDING CASSETTE AND IMAGE FORMING APPARATUS

(71) Applicant: Konica Minolta, Inc., Tokyo (JP)

(72) Inventors: Shinji Yanase, Shinshiro (JP); Takahiko Ushiroji, Hino (JP); Dong Zhang, Toyohashi (JP); Yoshitada Ichikawa, Anjo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/276,406

(22) Filed: May 13, 2014

(65) Prior Publication Data

US 2014/0339762 A1 Nov. 20, 2014

(30) Foreign Application Priority Data

May 17, 2013 (JP) ..... 2013-104600

(51) Int. Cl.
*B65H 1/08* (2006.01)
*B65H 1/26* (2006.01)

(52) U.S. Cl.
CPC ..... *B65H 1/266* (2013.01); *B65H 2405/11171* (2013.01); *B65H 2405/12* (2013.01); *B65H 2511/212* (2013.01); *B65H 2515/10* (2013.01); *B65H 2601/325* (2013.01)

(58) Field of Classification Search
CPC ..... G06K 13/08; G06K 13/10; B65H 1/14; B65H 2511/20; B65H 2801/21; B65H 1/04; B65H 1/266; B65H 1/20; B65H 2405/11162; B65H 2405/1117; B65H 2405/11172; B65H 2405/1124; B65H 2405/354
USPC ..... 271/163, 152, 147, 148, 162, 171, 157, 271/145
See application file for complete search history.

(56) References Cited

U.S. PATENT DOCUMENTS

| | | | | |
|---|---|---|---|---|
| 5,364,087 | A * | 11/1994 | Schieck et al. | 271/148 |
| 5,419,645 | A * | 5/1995 | Russo | 400/624 |
| 6,283,469 | B1 * | 9/2001 | Weber | 271/148 |
| 6,357,740 | B1 * | 3/2002 | Inoue et al. | 271/160 |
| 7,559,547 | B2 * | 7/2009 | Van Dongen et al. | 271/148 |
| 2006/0284366 | A1 | 12/2006 | Van Dongen et al. | |
| 2007/0102870 | A1 * | 5/2007 | Moore et al. | 271/152 |
| 2011/0210501 | A1 * | 9/2011 | Shiokawa et al. | 271/241 |
| 2011/0222092 | A1 * | 9/2011 | Marasco et al. | 358/1.13 |

FOREIGN PATENT DOCUMENTS

| | | |
|---|---|---|
| JP | 59-54438 | 4/1984 |
| JP | 5-37811 | 5/1993 |
| JP | 5-294471 | * 11/1993 |
| JP | 2007-230699 A | 9/2007 |

OTHER PUBLICATIONS

Machine translation of JP 5-294471.*

(Continued)

*Primary Examiner* — Thomas Morrison
(74) *Attorney, Agent, or Firm* — Lucas & Mercanti, LLP

(57) ABSTRACT

In a paper feeding cassette storing stacked sheets, a rotary lever adapted to rotate vertically about a rotation fulcrum is provided with a lift-up portion for lifting up the sheets as placed in contact with a bottom of the sheets stored in the paper feeding cassette. The lift-up portion is vertically turned by the rotary lever.

6 Claims, 7 Drawing Sheets

(56) References Cited

OTHER PUBLICATIONS

Office Action dated Mar. 12, 2015 for the corresponding Japanese Patent Application No. 2031-104600 (2 pages).
English translation of Office Action dated Mar. 12, 2015 for the corresponding Japanese Patent Application No. 2031-104600 (2 pages).
Chinese Office Action; Application No. 201410198009.8; Dispatch Date; Dec. 16, 2015; total of 6 pages.
English translation of Chinese Patent Application; total of 3 pages.

* cited by examiner

PAPER FEEDING CASSETTE AND IMAGE FORMING APPARATUS

The priority application Number Japanese Patent Application 2013-104600 upon which this application is based is hereby incorporated by reference.

BACKGROUND OF THE INVENTION

Field of the Invention

The present invention relates to a paper feeding cassette storing stacked sheets therein and an image forming apparatus employing this paper feeding cassette. Particularly, a feature of the invention consists in the paper feeding cassette which is adapted for easy strain-free extraction of the stacked sheets from the paper feeding cassette when the sheets stacked and stored in the paper feeding cassette are taken out.

Description of the Related Art

In image forming apparatuses such as copiers, printers, facsimiles and multi-functional peripherals thereof, it has been a general practice to feed a sheet from the paper feeding cassette storing the stacked sheets therein and to guide the fed sheet into an image forming process so as to allow a toner image to be formed on this sheet.

To change the type or size of the sheets for image formation in such image forming apparatuses, it has been a practice to take out the stacked sheets from the paper feeding cassette and to stack new sheets in the paper feeding cassette.

The following problem may be encountered when the sheets stacked in the paper feeding cassette are taken out of the paper feeding cassette. In a case where a gap between the stored sheets and the paper feeding cassette is small, it is difficult to take out the sheets from the paper feeding cassette by inserting a hand in the gap between the stored sheets and the paper feeding cassette. If an operator tries to take out the sheets from the paper feeding cassette by forcibly inserting his hand into the gap between the sheets and the paper feeding cassette, the hand may be abraded against the paper feeding cassette or the sheet may be strained and folded.

As disclosed in a patent document 1 (JP-A No. 2007-230699), there has heretofore been proposed a paper feeding cassette storing the stacked sheets therein, which is formed with a hole ox notch in a bottom thereof such as to permit a finger to be inserted through this hole or notch for pushing up the sheets from the bottom of the paper feeding cassette.

However, the operation of inserting the finger through, the hole or notch formed in the bottom of the paper feeding cassette and pushing up the sheets from the bottom of the paper feeding cassette is not only cumbersome, but also involves fear of cutting the finger. Particularly, in a case where the number of sheets stacked in the paper feeding cassette is so large that the sheet stack has a substantial weight, the operation of pushing up the sheets from the bottom of the paper feeding cassette becomes even more difficult.

SUMMARY OF THE INVENTION

According to the invention, a paper feeding cassette storing stacked sheets includes: a lift-up portion for lifting up the sheets stored in the paper feeding cassette, and a rotary lever provided at the lift-up portion and vertically rotatable about, a rotation fulcrum.

An image forming apparatus according to the invention includes the above-described paper feeding cassette.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

Figure 1:
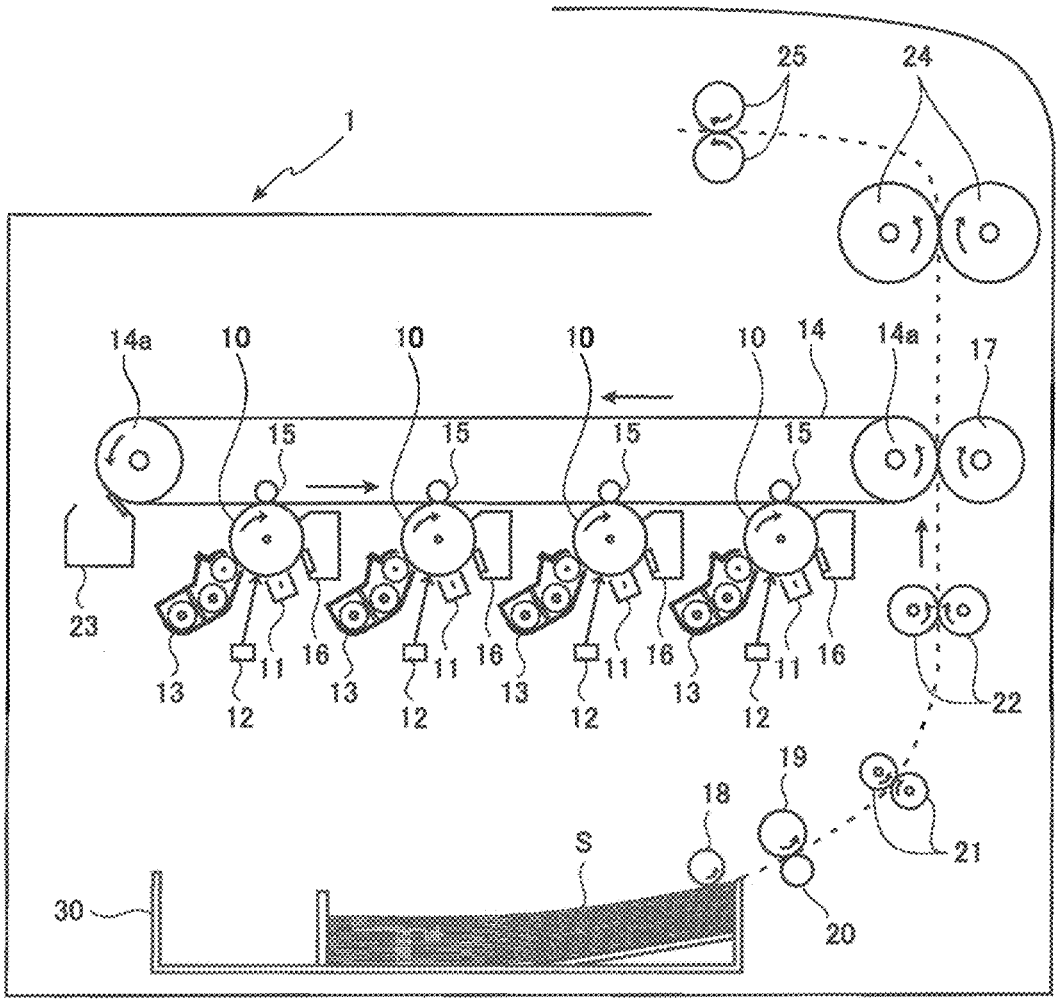
FIG. 1 is a schematic illustration showing an image forming apparatus employing a paper feeding cassette according to an embodiment of the invention.

According to the paper feeding cassette of the invention, the above-described lift-up portion can be turned upward about the rotation fulcrum by means of the above-described rotary lever so that the sheets stored in the paper feeding cassette can be lifted up by this lift-up portion.

If the arrangement is made such that the lift-up portion is turned upward about the rotation fulcrum by the rotary lever whereby the sheets stored in the paper feeding cassette are lifted up by the lift-up portion, the sheets stacked, and stored in the paper feeding cassette are less susceptible to strain when taken out of the paper feeding cassette. Thus, the sheets can be easily extracted from the paper feeding cassette.

Accordingly, when the type or size of sheets for image formation is changed, the paper feeding cassette of the invention negates the need for performing the cumbersome, unsafe conventional operation of inserting the finger through the hole or notch formed in the bottom of the paper feeding cassette and pushing up the sheets from the bottom of the paper feeding cassette. The paper feeding cassette of the invention provides easy strain-free extraction of the stacked sheets from the paper feeding cassette, facilitating the operation of changing the type or size of the sheets for image formation.

According to the above-described paper feeding cassette, the rotation fulcrum of the rotary lever can be shifted in a sheet loading direction.

The above-described rotation fulcrum is adapted to be shifted in the sheet loading direction according to the volume of sheets stored in the paper feeding cassette. It is preferred that the position of the rotation fulcrum is shifted toward the above-described lift-up portion in a case where the volume of sheets stored in the paper feeding cassette is large, and that the position of the rotation fulcrum is shifted away from the lift-up portion in a case where the volume of sheets stored in the paper feeding cassette is small. If the position of the rotation fulcrum is shifted toward the lift-up portion when a large volume of sheets is stored in the paper feeding cassette, a distance between the rotation fulcrum and the force point where the force to rotate the rotary lever is applied is increased. Even when a large volume of sheets is stored in the paper feeding cassette, therefore, the rotary lever can be rotated with a small force so that the lift-up portion is easily driven to lift up the sheets stored in the paper feeding cassette. On the other hand, if the position of the rotation fulcrum is shifted away from the above described lift-up portion when a small volume of sheets is stored in the paper feeding cassette, rotating the rotary lever brings the above-described lift-up portion into a wide upward turn so that the sheets stored in the paper feeding cassette are lifted way up by the lift-up portion. This facilitates the extraction of the sheets stored in the paper feeding cassette.

Next, the paper feeding cassette according to the invention and an embodiment of an image forming apparatus employing this paper feeding cassette are specifically described with reference to the accompanying drawings. It is noted that the paper feeding cassette and the image forming apparatus according to the invention are not limited to the following embodiments and the invention can be appropriately carried out in various ways without departing from the spirit and scope of the invention.

According to this embodiment, as shown in FIG. 1, a paper feeding cassette 30 storing a plurality of stacked sheets S therein is mounted in an image forming apparatus 1 at a lower part thereof. The paper feeding cassette 30 is removably mounted in the image forming apparatus 1 in a manner to be drawn out of the image forming apparatus 1 to the front side, thereof as seen in FIG. 1.

The image forming apparatus 1 contains therein four photoreceptor drums 10 and four developing units 13 which correspond to the respective photoreceptor drums 10 and accommodate therein respective developers. The developing units 13 individually employ toners of different colors, namely black toner, yellow toner, magenta toner and cyan toner in the respective developers.

In this image forming apparatus 1, each of the photoreceptor drums 10 is rotated to allow the surface thereof to be electrically charged by each charger unit 11; and the charged surface of each photoreceptor drum 10 is exposed to light by each latent image forming unit 12 according to image information so that an electrostatic latent image is formed on the surface of each photoreceptor drum 10.

Subsequently, the electrostatic latent image formed on each of the photoreceptor drums 10 is developed by supplying thereto a toner of a predetermined color from each corresponding developing unit 13. Thus, toner images of the individual colors are formed on the individual surfaces of the photoreceptor drums 10.

The toner images of the individual colors formed on the individual photoreceptor drums 10 as described above are primarily transferred in turn to a surface of an endless intermediate transfer belt 14 by means of individual primary transfer rollers 15 opposed to the individual photoreceptor drums 10. The endless intermediate transfer belt 14 is entrained between and rotatably driven by rotary rollers 14*a*. Thus, a toner image composite with the toner images of the individual colors is formed on the surface of this intermediate transfer belt 14. The toner untransferred to the intermediate transfer belt 14 and remaining on the surface of each photoreceptor drum 10, and the like are removed therefrom by each first cleaning unit 16.

The intermediate transfer belt 14 carries the toner image thus formed thereon to place opposed to a secondary transfer roller 17.

On the other hand, a sheet S stored in the paper feeding cassette 30 mounted in the image forming apparatus 1 at the lower part thereof is extracted from the paper feeding cassette 30 by a pickup roller 18 and is guided into space between a paper feeding roller 19 and a separator roller 20. In a case where overlapped sheets S are guided into the space, the overlapped sheets S are separated by the paper feeding roller 19 and the separator roller 20 so that one sheet S is allowed to pass through the space between the paper feeding roller 19 and the separator roller 20 to be delivered to a feed roller pair 21. The feed roller pair 21 delivers the sheet S to a timing roller pair 22.

The timing roller pair 22 delivers the sheet S to space between the intermediate transfer belt 14 and the secondary transfer roller 17 in synchronism with time when the toner image formed on the intermediate transfer belt 14 is delivered to place opposed to the secondary transfer roller 17. Thus, the toner image formed on the intermediate transfer belt 14 is transferred, to the sheet S by the secondary transfer roller 17. The toner untransferred to the sheet S and remaining on the intermediate transfer belt 14, and the like are removed therefrom by a second cleaning unit 23.

The sheet S with the toner image transferred thereto as described above is delivered to a fixing unit 24, which fixes the transferred toner image onto the sheet S. Subsequently, the sheet S with the toner image fixed thereto is discharged by a discharge roller pair 25.

When the type or size of the sheets S for image formation is changed in the above-described image forming apparatus 1, the paper feeding cassette 30 mounted in the image forming apparatus 1 at the lower part thereof is drawn out of the image forming apparatus 1 to the front side thereof as described above. The sheets S stacked and stored in the paper feeding cassette 30 are taken out of the paper feeding cassette 30.

Figure 2:
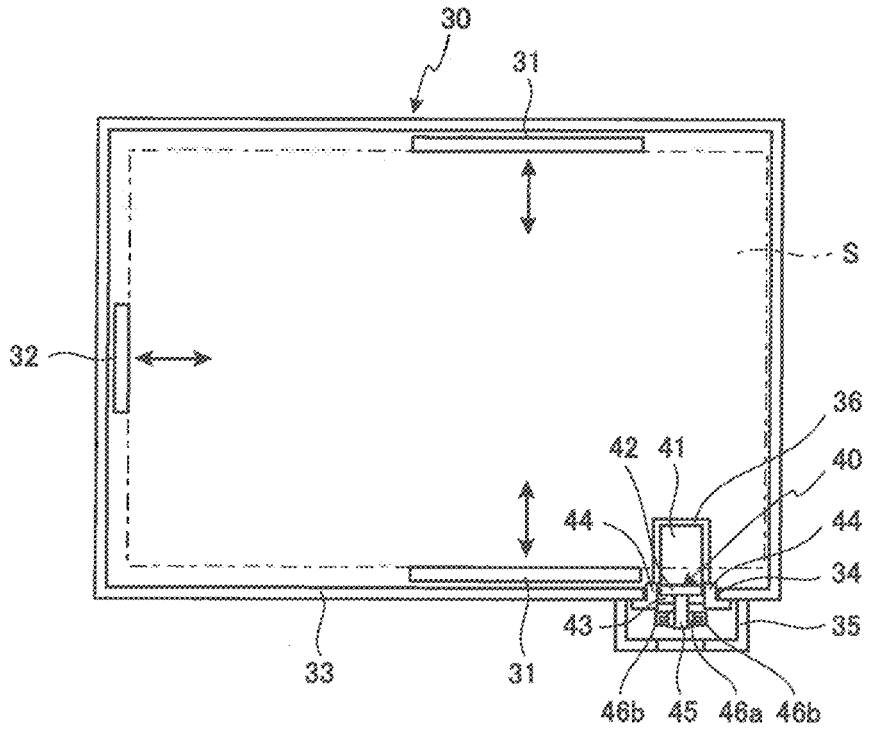
FIG. 2 is a schematic plan view showing the paper feeding cassette according to the embodiment of the invention.

As shown in FIG. 2, the paper feeding cassette 30 according to the embodiment includes: a pair of width regulating members 31, 31 serving to regulate the widthwise opposite ends of the sheets S stored in the paper feeding cassette 30 and configured to be movable in a width direction of the sheet S; and a trailing-end regulating member 32 serving to regulate a trailing end of the sheets S and configured to be movable in a sheet-S feeding direction.

In a case where the sheets S stored in this paper feeding cassette 30 is large in size, or where A3-size sheets are stored in the paper feeding cassette 30, for example, a gap between the sheets S and a side wall 33 of the paper feeding cassette 30 is so small that it is difficult to extract the sheets S by inserting the finger into the gap between the sheets S and the side wall 33.

Figure 3A:
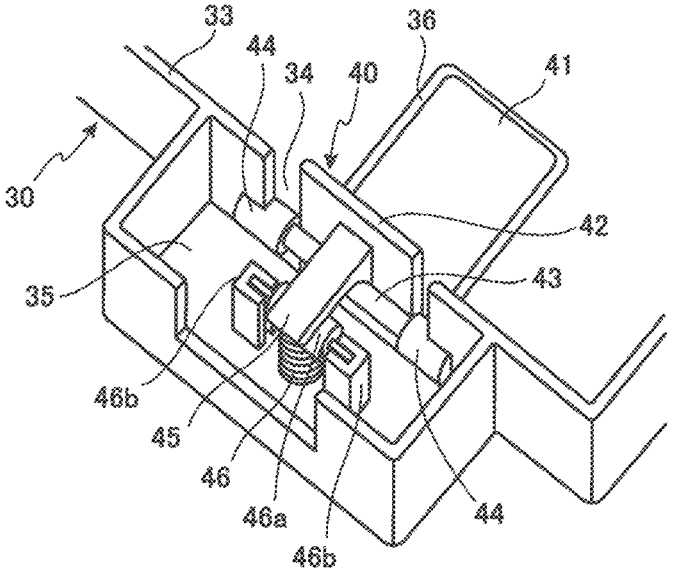
FIGS. 3A and 3B illustrate the paper feeding cassette according to the embodiment which is provided with a rotary lever on a side wall thereof at place near a leading end of sheet in a sheet feeding direction, FIG. 3A showing a fragmentary perspective view thereof and FIG. 3B showing a fragmentary sectional illustration thereof.
Figure 3B:
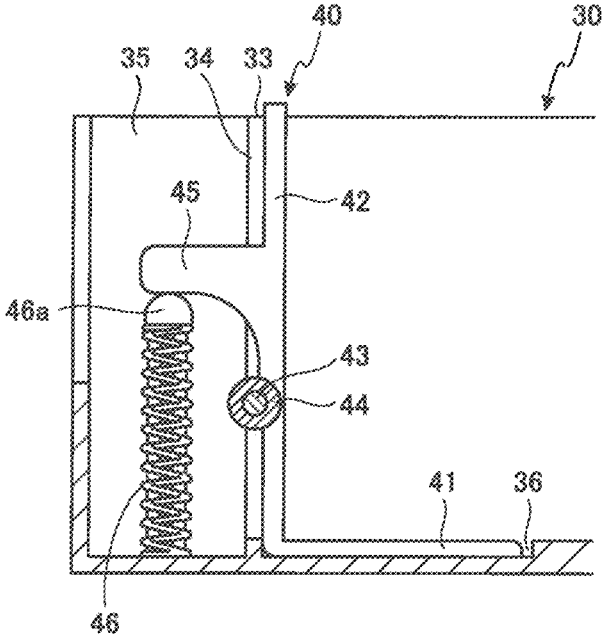

As shown in FIG. 2, FIG. 3A and FIG. 3B, therefore, the paper feeding cassette 30 according to this embodiment is provided with a single lift-up portion 41 on the front side wall 33 from which the paper feeding cassette is drawn out of the image forming apparatus 1 and at place near a leading end of the sheet in the sheet-S feeding direction (on a downstream side in the sheet-S feeding direction). The lift-up portion 41 is configured to lift up the sheets S as placed in contact with a bottom side of the sheet stack S stored in the paper feeding cassette 30. The paper feeding cassette 30 is further provided with a rotary lever 40 to vertically turn the lift-up portion 41 about a rotation fulcrum P.

In the paper feeding cassette 30 according to this embodiment, the above-de scribed side wall 33 is formed with a notch 34 at place near the leading end of the sheets S the sheet-S feeding direction in order to permit the above described, rotary lever 40 to be mounted to the above described side wall 33 at place near the leading end of the sheets S in the sheet-S feeding direction. A rotary-lever housing portion 35 for housing the rotary lever 40 is formed on a back side of the side wall 33 in a manner to enclose this notch 34, Further, a recess 36 to receive the lift-up portion 41 of the above-described rotary lever 40 is formed in a bottom of the paper feeding cassette 30 at place corresponding to this notch 34.

In the above-described rotary lever 40, on the other hand, a lever portion 42 extends upward from the lift-up portion 41 received in the above-described recess 36, while a pivot shaft 43 is mounted on a back side, of the lever portion 42 at a predetermined height in a manner to project from the opposite sides of the lever portion 42. Bearing members 44, 44 for rotatably retaining the pivot shaft 43 are mounted on projecting opposite ends of the pivot shaft 43, respectively. The bearing members 44, 44 are located on the back side of the side wall 33 of the paper feeding cassette 30 on the opposite sides of the notch 34 so as to allow the Aotary lever 40 to be moved vertically relative to the side wall 33 of the paper feeding cassette 30. Further, the pivot shaft 43 rotatably retained by the bearing members 44, 44 also allows the rotary lever 40 to be rotated vertically. A projection 45 is formed on a back side of the lever portion 42 and located a required distance upward from this pivot shaft 43. This projection 45 has a lower side formed in an arcuate shape.

A spring member 46 extends upward from, a bottom of the rotary-lever housing portion 35. A retaining portion 46*a* having an arcuately projected top face is mounted on an upper end of the spring member 46. With the retaining portion 46*a* guided by guide, members 46*b*, 46*b* disposed on the both sides of the spring member 46, the spring member 46 urges the projection 45 upward by pressing the arcuately projected top face thereof against the arcuate lower side of the projection 45. Furthermore, the spring member 46 also urges the lift-up portion 41 to turn about the pivot shaft 43 as the fulcrum in a direction to be received in the recess 36.

Figure 4A:
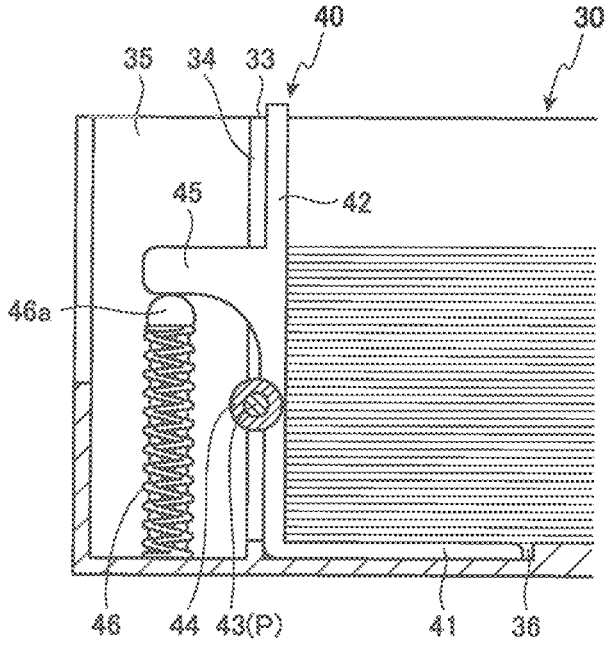
FIGS. 4A and 4B illustrate the paper feeding cassette, according to the above embodiment, showing an example where the rotary lever is rotated with a large volume of sheets stored in the paper feeding cassette, FIG. 4A showing a fragmentary sectional illustration of a state before the rotary lever is rotated and FIG. 4B showing a fragmentary sectional illustration of a state where the rotary lever is rotated to drive a lift-up portion to lift up the sheets stored in the paper feeding cassette.
Figure 4B:
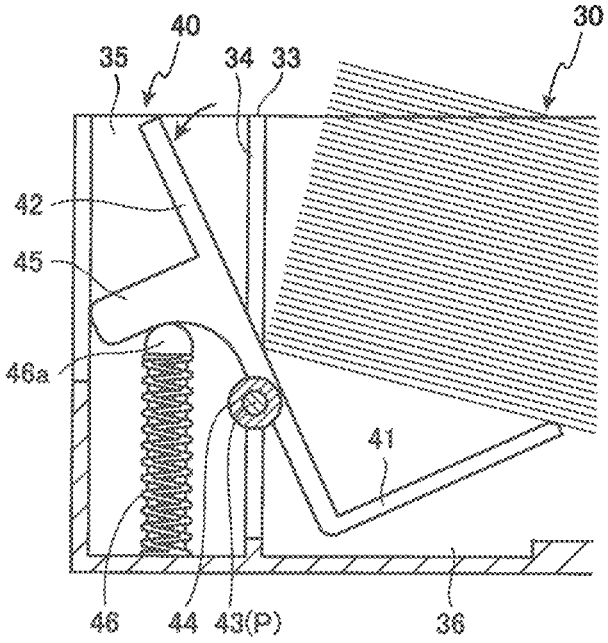

In a case where an upper end of the rotary lever 40 on the opposite side from the lift-up portion 41 is turned down to the back side of the side wall 33 of the paper feeding cassette 30 storing a large volume of sheets therein, as shown in FIG. 4A and FIG. 4B, the bearing members 44 rotatably retaining the pivot, shaft 43 are maintained at a lower position because of the heavy weight of the sheets S stored in the lift-up portion 41. In this state, the rotary lever 40 is rotated about the pivot shaft 43 as the rotation fulcrum F while allowing the arcuate retaining portion 46*a* of the spring member 46 to make sliding contact with the arcuate lower side of the projection 45. In conjunction with this, the lift-up portion 41 is turned upward so that the sheets S stored in the paper feeding cassette 30 are lifted up by this lift-up portion 41.

In this case, the distance between the pivot shaft 43 as the rotation fulcrum P and the upper end of the rotary lever 40 as the force point where the force to rotate the rotary lever 40 is applied is increased. With a large volume of sheets S stored, in the paper feeding cassette 30, therefore, the rotary lever 40 can be rotated with a small force so that the sheets S stored in the paper feeding cassette 30 can be easily lifted up.

Figure 5A:
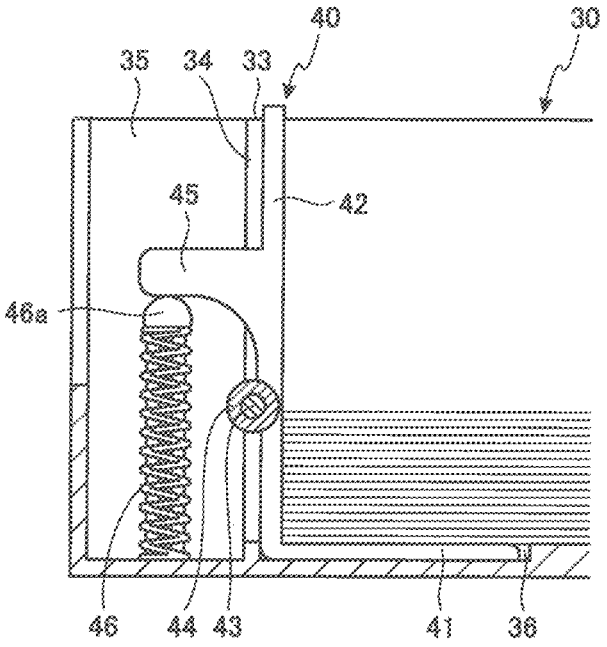
FIGS. 5A and 5B illustrate the paper feeding cassette according to the above embodiment, showing an example where the rotary lever is rotated with a small volume of sheets stored in the paper feeding cassette, FIG. 5A showing a fragmentary sectional illustration of a state before the rotary lever is rotated and FIG. 5B showing a fragmentary sectional, illustration of a state where the rotary lever is rotated to drive the lift-up portion to lift, up the sheets stored in the paper feeding cassette.
Figure 5B:
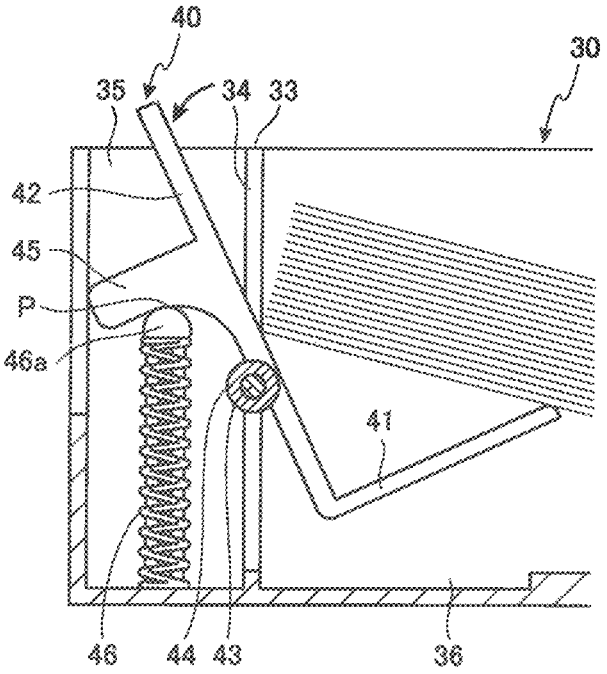

In a case where the upper end of the rotary lever 40 on the opposite side from the lift-up portion 41 is turned down to the hack side of the side wall 33 of the paper feeding cassette 30 storing a small volume of sheets therein, as shown in FIG. 5A and FIG. 5B, the weight of the sheets S stored in the lift-up portion 41 is small so that the bearing members 44 rotatably retaining the pivot shaft 43 are moved upward by the urging force of the spring member 46 while shifting the contact point between the arcuate lower side of the projection 45 and the arcuate retaining portion 46*a* of the spring member 46. In this state, the rotary lever 40 is rotated about the contact point between the retaining portion 46*a* of the spring member 46 and the arcuate lower side of the projection 45, as the rotation fulcrum P. In conjunction with this, the lift-up portion 41 is turned, upward as lifted up from the bottom of the paper feeding cassette 30 so that the sheets S stored in the paper feeding cassette 30 are lifted up by this lift-up portion 41.

In this case, the lift-up portion 41 is turned as lifted up from the bottom of the paper feeding cassette 30 while increased is the distance between the contact point between the retaining portion 46*a* of the spring member 46 and the arcuate lower side of the projection 45, which defines the rotation fulcrum P, and the lift-up portion 41. Hence, the lift-up portion 41 is turned way up by merely rotating the rotary lever 40 a bit so that, the sheets S stored in the paper feeding cassette 30 are lifted way up by the lift-up portion 41. This facilitates the operation of extracting the sheets S stored in the paper feeding cassette 30.

In the paper feeding cassette 30 according to this embodiment, the rotary lever 40 for vertically turning the lift-up portion 41 is disposed at the front side wall 33 from which the paper feeding cassette is drawn out of the image forming apparatus 1, and is located near a downstream end of the side wall in the sheet-S feeding direction. Therefore, in comparison to a case where the rotary lever 40 is disposed centrally of the side wall in the sheet-S feeding direction, the weight of the sheets S that is applied to the lift-up portion 41 is decreased when the lift-up portion 41 is turned upward by the rotary lever 40 to lift up the sheets S stored in the paper feeding cassette 30. The rotary lever 40 can be rotated with a smaller force so that the lift-up portion is easily driven to lift up the sheets stored in the paper feeding cassette 30. The liftup portion 41 is located near the downstream end in the sheet-S feeding direction and configured to lift up the sheets S by being vertically turned by the rotary lever 40. Therefore, the paper feeding cassette of the embodiment only needs one such rotary lever 40 and one such lift-up portion 41 to handle various types of sheets ranging from long sheets to short sheets. What is more, the paper feeding cassette of the embodiment, also offers a more beneficial, effect in terms of economy than a case where more than one rotary levers 40 and lift-up portions 41 are provided.

When the sheets S are lifted up by manipulating the rotary lever 40 to turn the lift-up portion 41 vertically as described above, an operator can hold and take out the lifted, sheets S with one hand while pushing the rotary lever 40 with the other hand. The operation of extracting the sheets S stored in the paper feeding cassette 30 can be accomplished easily.

When the rotary lever 40 is manipulated to vertically turn the lift-up portion 41 about the rotation fulcrum for lifting up the sheets S stored in the paper feeding cassette 30, the method, of shifting the above-described rotation fulcrum according to the volume of sheets S stored in the paper feeding cassette 30 is not limited to that described above.

Figure 6A:
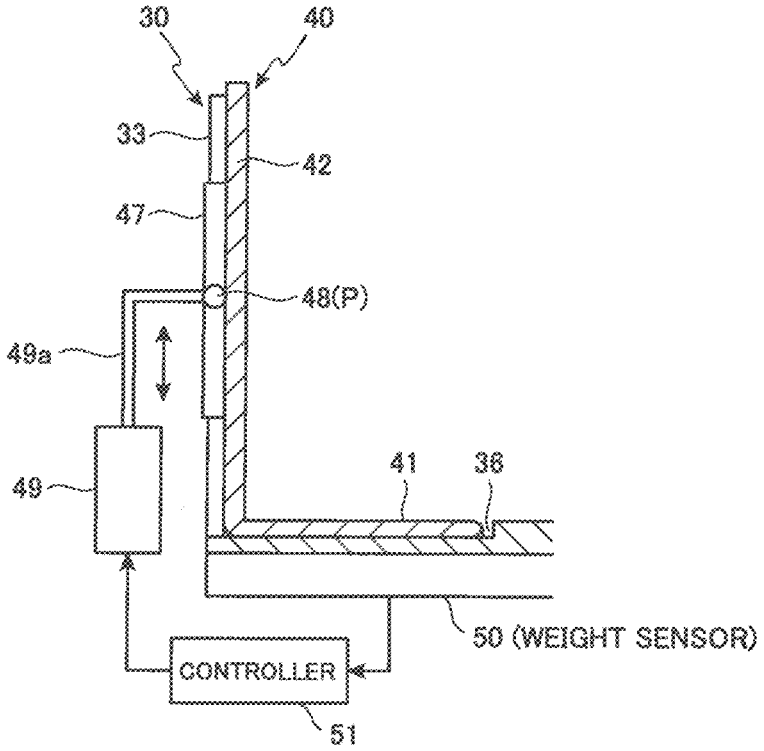
FIGS. 6A and 6B illustrate the paper feeding cassette according to the embodiment, showing an exemplary modification of the rotary lever provided at the paper feeding cassette, FIG. 6A showing a fragmentary sectional illustration of a state where a rotary lever according to the exemplary modification is provided at the paper feeding cassette and FIG. 6B showing a fragmentary illustration of a back side of the rotary lever according to the exemplary modification provided at the paper feeding cassette.
Figure 6B:
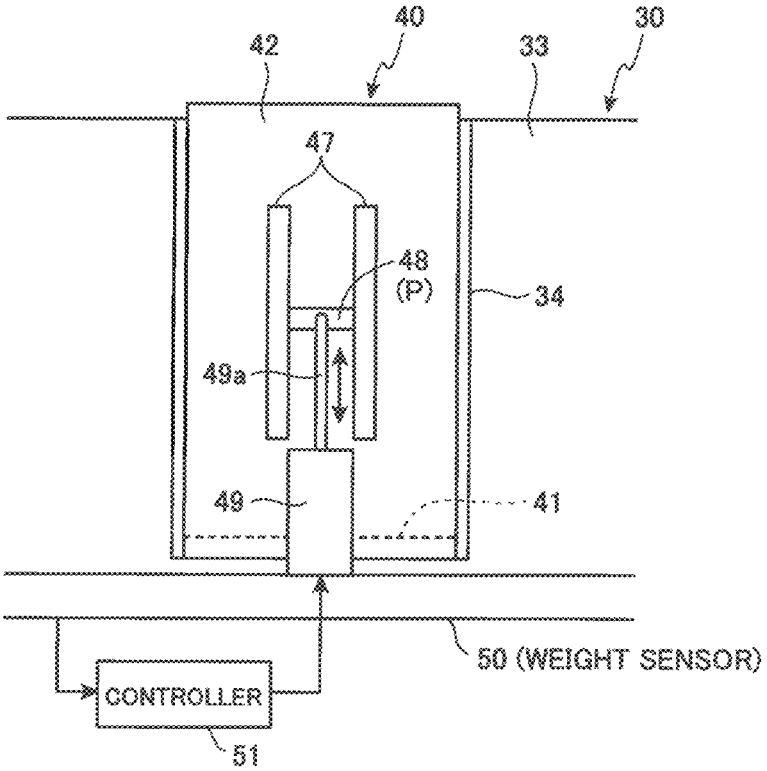

As shown in FIG. 6A and FIG. 6B, for example, a pair of vertically extended guide rails 47, 47 may be fixed to the back side of the lever portion 42 extended, upward from the lift-up portion 41 of the rotary lever 40. A shaft member 48 defining the rotation fulcrum P may be vertically slidably retained between this pair of guide rails 47, 47 and mounted on a rod member 49*a* vertically contractible by a cylinder 49. The rotation fulcrum P of the rotary lever 40 can be vertically shifted by vertically moving the shaft member 48 along the guide rail pair 47, 47 by means of the rod member 49*a* driven by the cylinder 49. In this case, a weight sensor 50 may be provided under the paper feeding cassette 30 so that the weight of the sheets S stored in the paper feeding cassette 30 is detected by this weight sensor 50. The weight sensor outputs a detection result to a controller 51 which, in turn, controls the above-described cylinder 49 accordingly.

Figure 7A:
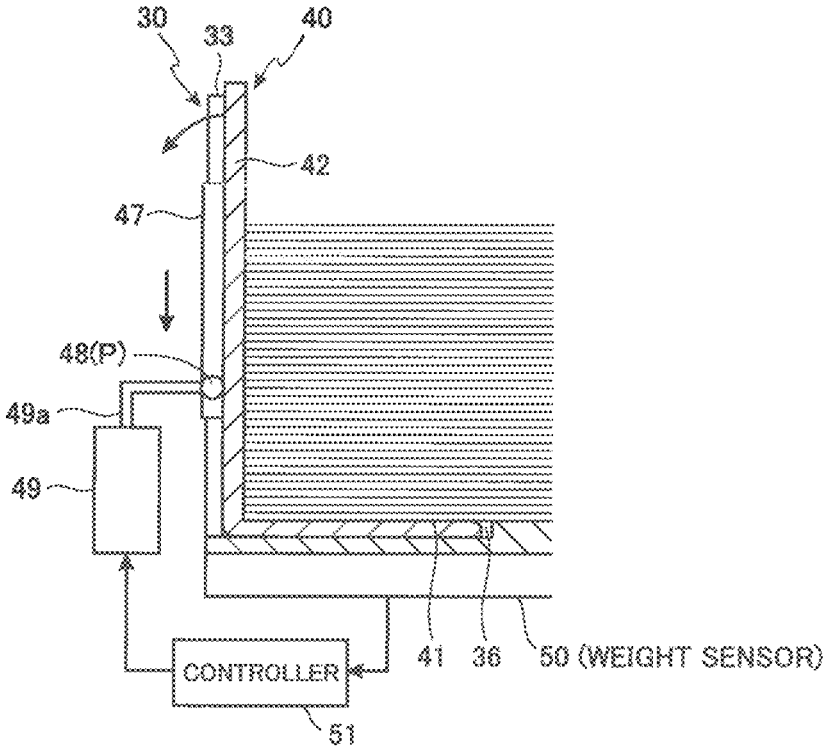
FIGS. 7A and 7B illustrates the above exemplary modification, FIG. 7A showing a fragmentary sectional illustration of an example where the rotary lever is rotated with a large volume of sheets stored in the paper feeding cassette and FIG. 7B showing a fragmentary sectional illustration of an example where the rotary lever is rotated with a small volume of sheets stored in the paper feeding cassette.

In a case where the weight of the sheets S stored in the paper feeding cassette 30 is great, the rod member 49*a* of the cylinder 43 is contracted to lower the above described shaft member 48 along the pair of guide rails 47, 47, as shown in FIG. 7A, so as to increase the distance between the above-described shaft member 48 defining the rotation fulcrum P and the upper end of the rotary lever 40 defining the force point where the force to rotate the rotary lever 40 is applied. Thus, the rotary lever 40 is adapted to be rotated with a small force such that the lift-up portion 41 is easily driven to lift up the sheets S stored in the paper feeding cassette 30.

Figure 7B:
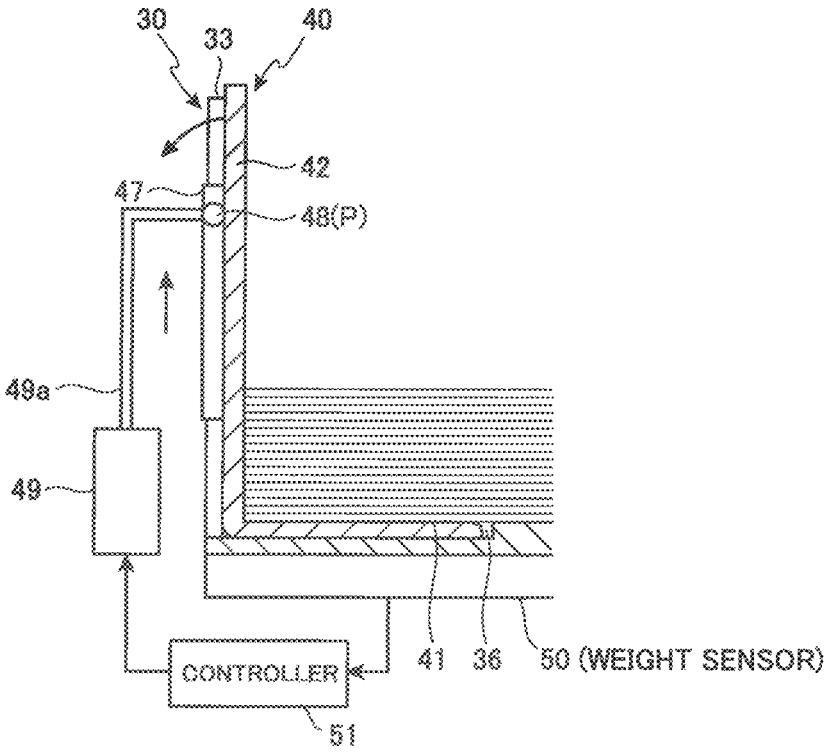

On the other hand, in a case where the weight of the sheets S stored in the paper feeding cassette 30 is small, the rod member 49*a* of the cylinder 43 is extended to raise the above-described, shaft member 48 along the pair of guide rails 47, 47, as shown in FIG. 7B, so as to increase the distance between the shaft member 48 defining the rotation fulcrum P and the lift-up portion 41. Hence, the lift-up portion 41 is turned way up by merely rotating the rotary lever 40 a bit so that the sheets S stored in the paper feeding cassette 30 are lifted way up by the lift-up portion 41.

While this embodiment illustrates the example where the rotary lever 40 is mounted to the paper feeding cassette 30 where, a pair of width regulating members 31, 31 for regulating the widthwise opposite ends of the sheets S is configured to be movable in the width direction of the sheet S, and where the trailing-end regulating member 32 for regulating the trailing end of the sheets S is configured to be movable in the sheet-S feeding direction, the type of the paper feeding cassette 30 provided with the rotary lever 40 is not limited to this. For example, the above-described rotary member 40 may also be similarly mounted to a paper feeding cassette 30 which is not provided with the above described width regulating members 31, 31 or trailing-end regulating member 32 and has a size corresponding to the size of sheets to be stored.

Although the present, invention has been fully described by way of examples, it is to be noted that various changes and modifications will be apparent to those skilled in the art.

Therefore, unless otherwise such changes and modifications depart from the scope of the present invention, they should be construed as being included therein.

The invention claimed is:

1. An image forming apparatus comprising:

an image forming unit for forming an image on a sheet of paper;

a paper feeding cassette removably mounted in the image forming apparatus and storing sheets to be supplied to the image forming unit;

a rotary lever for vertically turning a lift-up portion about a rotation fulcrum, the lift-up portion serving to lift-up the sheets stored in the paper feeding cassette, wherein the rotary lever is fixed with respect to the lift-up portion so that the rotary lever moves with the lift-up portion about the rotation fulcrum, and the rotation fulcrum is shiftable in a vertical direction;

a slider mounted to a side wall of the paper feeding cassette and vertically shiftably supporting the rotation fulcrum of the rotary lever; and a spring interposed between the rotary lever and a bottom surface of the paper feeding cassette and applying force in a direction to increase distance between the rotary lever and the bottom surface of the paper feeding cassette, wherein the rotary lever includes: a lever portion having the rotation fulcrum; the lift-up portion connected to one end of the lever portion and projected toward a bottom of sheets stored in the paper feeding cassette; and a projection connected to the lever portion on the opposite side from the lift-up portion via the rotation fulcrum and projected to the opposite side from the lift-up portion, and wherein the spring abuts against the projection of the lever portion.

2. The image forming apparatus according to claim 1, wherein the paper feeding cassette is mounted in the image forming apparatus in a manner to be drawable therefrom, and wherein the rotary lever is mounted to a front side wall of the paper feeding cassette with respect to a direction to draw out the paper feeding cassette.

3. The image forming apparatus according to claim 2, wherein the paper feeding cassette is mounted in the image forming apparatus in a manner to be drawable in a direction perpendicular to a sheet feeding direction, and wherein the rotary lever is disposed at a position downstream from a center of the paper feeding cassette in the sheet feeding direction.

4. A paper feeding cassette storing stacked sheets comprising:

a lift-up portion placed between the stacked sheets stored in the paper feeding cassette and a bottom of the paper feeding cassette;

a rotary lever fixed with respect to the lift-up portion and placed between the stacked sheets stored in the paper feeding cassette and a side wall of the paper feeding cassette;

a projection of the rotary lever fixed to the opposite side from the lift-up portion; and a spring member provided between the bottom of the paper feeding cassette and a lower side of the projection, wherein the projection of the rotary lever has the lower side formed in an arcuate shape, and wherein a contact point between the arcuate lower side and a retaining portion of the spring member is shifted along the arcuate lower side by integrally rotating the lift-up portion and the rotary lever.

5. The paper feeding cassette according to claim 4, comprising a support member vertically movably supporting the rotary lever and the lift-up portion along the side wall of the paper feeding cassette.

6. The paper feeding cassette according to claim 5, wherein the support member comprises a pivot shaft mounted on the rotary lever and bearing members disposed on the side wall of the paper feeding cassette for vertically slidably retaining the pivot shaft.

* * * * *